US006191099B1

(12) United States Patent
Crutcher

(10) Patent No.: US 6,191,099 B1
(45) **Date of Patent: *Feb. 20, 2001**

(54) METHOD FOR CLEANING HYDROCARBON-CONTAINING SOILS FROM SURFACES

(75) Inventor: Terry Crutcher, Fitchburg, WI (US)

(73) Assignee: Tomah Products, Inc., Milton, WI (US)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/294,267

(22) Filed: Apr. 19, 1999

Related U.S. Application Data

(63) Continuation-in-part of application No. 08/985,077, filed on Dec. 4, 1997, now abandoned.

(51) Int. Cl.[7] ..... C11D 9/00
(52) U.S. Cl. ..... 510/503; 510/499; 510/504
(58) Field of Search ..... 510/499, 503, 510/504

(56) References Cited

U.S. PATENT DOCUMENTS

| | | | | |
|---|---|---|---|---|
| 4,294,728 | * | 10/1981 | Vanlerberghe et al. | 252/542 |
| 5,634,984 | * | 6/1997 | Van Slyke | 134/40 |
| 5,719,118 | * | 2/1998 | Crutcher et al. | 510/499 |
| 5,972,875 | * | 10/1999 | Crutcher et al. | 510/421 |

* cited by examiner

*Primary Examiner*—John Hardee
(74) *Attorney, Agent, or Firm*—Jansson, Shupe, Bridge & Munger, Ltd.

(57) ABSTRACT

This invention is directed to an improved method for removing hydrocarbon-containing soils. The invention consists of preparing a detergent composition and applying the composition to the surface to be cleaned. Broadly, the detergent composition consists of from 1 to 99% by weight of at least one polyalkoxylated amine and from 99–1% by weight of at least one water-soluble surfactant. Other constituents may be added to enhance performance. The invention has desirable foamability characteristics.

21 Claims, No Drawings

METHOD FOR CLEANING HYDROCARBON-CONTAINING SOILS FROM SURFACES

RELATED APPLICATION

This patent application is a continuation-in-part of U.S. patent application Ser. No. 08/985,077 titled "Method for Cleaning Hydrocarbon-containing Soils From Surfaces" filed Dec. 4, 1997, abandoned.

FIELD OF THE INVENTION

This invention is related generally to cleaning and, more specifically, to a method of cleaning hydrocarbon-containing soils using an improved detergent composition.

BACKGROUND OF THE INVENTION

It is well known that removing oily, greasy and other hydrocarbon-containing soils from surfaces can be a difficult task. These hydrocarbon-containing soils include a wide range of substances such as motor oils, lards, lithium greases and other oily, greasy materials. Such soils are present in almost any household or commercial environment and can adhere to almost any surface including, without limitation, surfaces such as metal, wood, glass, synthetic and fabric.

Typical cleaning compounds used for removing these types of soils include solvents to solubilize the hydrocarbon-containing soils. While solvents present an effective method of removing these types of soils, they also include volatile organic compounds ("V.O.C.") which may be hazardous. In recent years many of the solvent containing cleaners have been completely banned or highly regulated because of the V.O.C. discharge. This regulation has created a need for alternative cleaning agents which do not include chlorofluorocarbons, V.O.C.s or other potentially hazardous constituents.

In addition, it is desirable to select a cleaning composition wherein the foamability of the composition can be easily controlled. Such control should include the ability to increase as well as decrease the level of foaming.

An improved method of cleaning oily, greasy and other hydrocarbon-containing soils from surfaces which is efficacious and yet avoids the need for potentially hazardous solvents and which has easily controllable foam characteristics would represent an important advance in the art.

OBJECTS OF THE INVENTION

It is an object of this invention to provide an improved method of cleaning hydrocarbon-containing soils that overcomes some of the problems and shortcomings of the prior art.

Another object of this invention is to provide an improved method of cleaning hydrocarbon-containing soils that includes a detergent composition with improved synergistic, cost-effective surface cleaning capabilities.

It is a further object of this invention to provide an improved method of cleaning hydrocarbon-containing soils that offers versatile high or low foamability suitable for a variety of applications.

Yet another object of this invention is to provide an improved method of cleaning hydrocarbon-containing soils that includes a detergent composition which can be prepared and used in a dilute form or as a 100% actives concentrate.

An additional object of the invention is to provide an improved method of cleaning hydrocarbon-containing soils which is effective yet does not require the use of organic solvents or builders.

These and other important objects will be apparent from the descriptions of this invention which follow.

SUMMARY OF THE INVENTION

The present invention is directed toward an improved method of cleaning oily, greasy and other hydrocarbon-containing soils from a wide range of surfaces including, without limitation, surfaces such as metal, wood, glass, synthetic materials and fabric. The invention is highly efficacious in removing these types of soils. Indeed, and as set forth in the Examples below, the constituents of the composition appear to have a synergistic effect in removing hydrocarbon-containing soils. The method accomplishes this desirable result without the need for solvents typical of the prior art cleaning compositions and methods.

The invention comprises the steps of preparing a detergent composition and applying the detergent composition to the object or surface to be cleaned. In one embodiment, the detergent composition comprises from 1 to 99% by weight of at least one polyalkoxylated amine component and from 99–1% by weight of at least one water-soluble amine oxide surfactant. The polyalkoxylated amine component has the general structural formula:

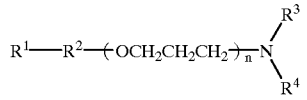

wherein $R^1$ is selected from an alkyl, aryl or alkylaryl group having between 6 and 22 carbon atoms, $R^2$ is from 0 to 7 moles of alkoxylated units, n is 0 or 1, $R^3$ and $R^4$ are each selected from a hydrogen atom ("H") and from 1 to 5 moles of alkoxylated units such that $R^3$ and $R^4$ are not both H and $R^3$ and $R^4$ combined include about 5 or fewer moles of alkoxylated units. Mixtures of the amines may be used.

The water-soluble surfactant for use in this embodiment of the invention is one of several amine oxides. Mixtures of these amine oxides may be used. These compounds will be described in greater detail below.

In another embodiment, the detergent composition of the inventive method comprises three main components. The first component is from 0.5–99% by weight of a polyalkoxylated amine as set forth above while the second component is from 99–0.5% by weight of water-soluble nonionic surfactants described in more detail below. Mixtures of these surfactants are acceptable.

The third component consists of from 99–0.5% by weight of a third constituent consisting of several quaternary ammonium compounds also described more detail below. Mixtures may be used.

As used throughout the specification and claims, terms such as "between 6 and 22 carbon atoms," C3 to C10 and $C_{1-5}$ are used to designate carbon atom chains of varying lengths and to indicate that various conformations are acceptable including branched, cyclic and linear conformations. The terms are further intended to designate that various degrees of saturation are acceptable.

DETAILED DESCRIPTIONS OF THE PREFERRED EMBODIMENTS

The detergent composition of the invention may be prepared as a solid or liquid using any conventional method. There is no particular order in which the constituents are combined. Liquid and solid forms of the invention require good dispersal of the constituents for maximum effectiveness. Solid forms of the composition may be prepared through known methods such as dry blending or spray drying in which the composition is applied to a dry substrate such as a zeolite.

The detergent composition may be applied in any suitable manner such as with an atomizer or other form of spray, by immersing the surface to be cleaned in the composition, pouring the detergent composition on the soil to be removed or by mixing a solid form of the composition with a solvent and the article to be cleaned. As will be discussed in the Examples below, the detergent composition is effective in removing the soil upon application.

As summarized above, one embodiment of the detergent composition comprises a blend of two main components including polyalkoxylated amines and a water soluble amine oxide surfactant. It is preferred that the polyalkoxylated amine component comprise from 1 to 99% by weight of the composition and that the water soluble amine oxide surfactant comprise from 99–1% by weight of the composition. The polyalkoxylated amines have the general structural formula:

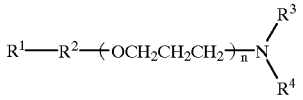

wherein $R^1$ is selected from an alkyl, aryl or alkylaryl group having between 6 and 22 carbon atoms, $R^2$ is from 0 to 7 moles of alkoxylated units; n is 0 or 1, $R^3$ and $R^4$ are each selected from a hydrogen atom ("H") and from 1 to 5 moles of alkoxylated units such that $R^3$ and $R^4$ are not both H and $R^3$ and $R^4$ combined include about 5 or fewer moles of alkoxylated units. Mixtures of the amines are within the scope of the invention.

The alkoxylated units are preferably selected from the group consisting of ethyleneoxy, propyleneoxy, butyleneoxy and mixtures thereof. Preferably, $R^3$ and $R^4$ combined include from about 1 to 2 moles of alkoxylated units.

Tomah Products, Inc. of Milton, Wis. manufactures and sells polyalkoxylated amines useful in practicing the invention. And example of a suitable Tomah polyalkoxylated amine is E-14-2.

A wide range of amine oxide water-soluble surfactants may be used in this form of the invention. The preferred amine oxide surfactant has the general structural formula:

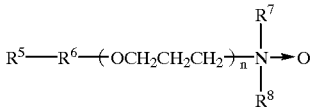

wherein $R^5$ is selected from an alkyl, alkylamidopropyl, hydroxyalkyl, aryl or alkylaryl group having between 6 and 22 carbon atoms, $R^6$ is from 0 to 7 moles of alkoxylated units, n is 0 or 1, $R^7$ and $R^8$ are each selected from the group consisting of 1 to 10 moles of alkoxylated units, a $C_{1-5}$ alkyl group, hydroxyalkyl and an organic group having between 6–26 atoms.

Preferably $R^7$ and $R^8$ combined include from about 2 to 7 moles of alkoxylated units. Lauryl dimethyl amine oxide and isodecyloxypropyl bis-hydroxyethyl amine oxide are examples of preferred amine oxide compositions. Tomah Products AO-14-2, Albemarle Corp., Baton Rouge, La., Admox, 1214 and Akzo Nobel Chemical, Chicago, Ill. Aromex C/12-N are commercially-available amine oxides useful in practicing the invention.

It is preferred that the polyalkoxylated amine component comprises from about 15–85% by weight of the composition and that the water-soluble amine oxide surfactant component comprises from about 85–15% by weight of the composition.

The alternative detergent compositions of the inventive method summarized above comprise a blend of three main components. The first component is from 0.5–99% by weight of at least one polyalkoxylated amine as set forth above.

The second component is from 99–0.5% by weight of at least one water-soluble nonionic surfactant selected from the group consisting of alkoxylated alkyl phenols, alkoxylated alcohols and alkoxylated glycosides including mixtures thereof.

Preferred alkoxylated alkyl phenols include the polyethylene, polypropylene, and polybutylene oxide condensates of alkyl phenols. In general, the polyethylene oxide condensates are preferred. These compounds include the condensation products of alkyl phenols having an alkyl group containing from about 6 to about 12 carbon atoms in either a straight chain or branched chain configuration with the alkylene oxide. In a preferred embodiment, the ethylene oxide is present in an amount equal to from about 2 to about 25 moles of ethylene oxide per mole of alkyl phenol. Preferred alkoxylated alkyl phenols are nonylphenol 9 mole ethoxylate and octylphenol 9 mole ethoxylate. Commercially available nonionic surfactants of this type include Igepal™ CO-630, marketed by the Rhône-Poulenc; and Triton™ X-45, X114, X100 and X102, all marketed by the Union Carbide Corporation.

Useful alkoxylated alcohols include the alkyl ethoxylate condensation products of aliphatic alcohols with from about 1 to about 25 moles of ethylene oxide. The alkyl chain of the aliphatic alcohol can either be straight or branched, primary or secondary, and generally contains from 8 to 22 carbon atoms. Particularly preferred are the condensation products of alcohols having an alkyl group containing from 10 to 20 carbon atoms with from about 2 to about 10 moles of ethylene oxide per mole of alcohol. Most preferred are the condensation products of alcohols having an alkyl group containing from 10 to 14 carbon atoms with from about 6 to about 10 moles of ethylene oxide per mole of alcohol. Preferred alkoxylated alcohols include dodecyl alcohol 7 mole ethoxylate, tridecyl alcohol 7 mole ethoxylate, tetradecyl alcohol 7 mole ethoxylate, dodecyl/pentadecyl alcohol 7 mole ethoxylate blend and hexadecyl alcohol 7 mole ethoxylate.

Examples of commercially available nonionic surfactants of this type include Tergitol™ 15-S-9 (the condensation product of C11–C15 linear alcohol with 9 moles ethylene oxide), Tergitol™ 24-L-6 NMW (the condensation product of C12–C14 primary alcohol with 6 moles ethylene oxide with a narrow molecular weight distribution), both marketed by Union Carbide Corporation; Neodol™ 45-9 (the condensation product of C14–C15 linear alcohol with 9 moles of ethylene oxide), Neodol™ 25-9 (the condensation product of C12–C15 linear alcohol with 9 moles of ethylene oxide), Neodol™ 23-6.5 (the condensation product of C12–C13 linear alcohol with 6.5 moles of ethylene oxide), Neodol™ 45-7 (the condensation product of C14–C15 linear alcohol with 7 moles of ethylene oxide), Neodol™ 45-4 (the condensation product of C14–C15 linear alcohol with 4 moles of ethylene oxide), marketed by Shell Chemical Company, and Kyro™ EOB (the condensation product of C13–C15 alcohol with 9 moles ethylene oxide), marketed by The Procter & Gamble Company.

Suitable alkoxylated glycosides include alkylpolysaccharides disclosed in U.S. Pat. No. 4,565,647 (Llenado) having a hydrophobic group containing from about 6 to about 30 carbon atoms, preferably from about 10 to about 16 carbon atoms and a polysaccharide, e.g., a polyglycoside, hydrophilic group containing from about 1.3 to about 10, preferably from about 1.3 to about 3, most preferably from about 1.3 to about 2.7 saccharide units. Any reducing saccharide containing 5 or 6 carbon atoms can be used, e.g., glucose, galactose and galactosyl moieties can be substituted for the glucosyl moieties. (Optionally, the hydrophobic group is attached at the 2-, 3-, 4-, etc. positions thus giving a glucose or galactose as opposed to a glucoside or galactoside.) The intersaccharide bonds can be, e.g., between the one position of the additional saccharide units and the 2-, 3-, 4-, and/or 6- positions on the preceding saccharide units.

The preferred alkylpolyglycosides have the formula:

$$R^2O(C_nH_{2n}O)_t(\text{glycosyl})_x$$

wherein $R^2$ is selected from the group consisting of alkyl, alkylphenyl, hydroxylalkyl, hydroxyalkylphenyl, and mixtures thereof in which the alkyl groups contain from 10 to 18, preferably from 12 to 14, carbon atoms; n is 2 or 3, preferably 2; t is from 0 to about 10, preferably 0; and x is from about 1.3 to about 10, preferably from about 1.3 to about 3, most preferably from about 1.3 to about 3, most preferably from about 1.3 to about 2.7. The glycosyl is preferably derived from glucose. To prepare these compounds, the alcohol or alkylpolyethoxy alcohol is formed first and then reacted with glucose, or a source of glucose, to form the glucoside (attachment at the 1-position). The additional glycosyl units can then be attached between their 1-position and the preceding glycosyl units 2-, 3-, 4- and/or 6-position, preferably predominately the 2-position. Dodecylpolyglycoside is an illustrative preferred alkoxylated glycosides.

A representative commercially-available example of a C10 to C16 alkyl polyglycoside is GLUCOPON™ 600 which is an alkyl polyglycoside surfactant solution (50% active) which has an average degree of polymerization of 1.4 glucose units, a hydrophilic-lipophilic balance of 11.6 (calculated value) and in which the alkyl group contains 12 to 16 carbon atoms (average C12.8). A representative example of a C3 to C10 alkyl polyglycoside is GLUCOPON™ 225 which is an alkyl polyglycoside surfactant solution (65% active) which has an average degree of polymerization of 1.6 glucose units, a hydrophilic-lipophilic balance of 13.6 (calculated value) and in which the alkyl group contains 8 to 10 carbon atoms (average C9.1). Such surfactants are commercially available from Henkel Corporation, Ambler, Pa. 19002 and are described in U.S. Pat. No. 5,266,690.

The third component consists of from 99–0.5% by weight of at least one quaternary ammonium compound component having the general structural formula:

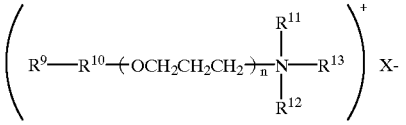

wherein $R^9$ is selected from an alkyl, alkylamidopropyl, hydroxyalkyl, aryl or alkylaryl group having between 6 and 22 carbon atoms, $R^{10}$ is from 0 to 7 moles of alkoxylated units, n is 0 or 1, $R^{11}$ and $R^{12}$ are each selected from the group consisting of 1 to 10 moles of alkoxylated units, a $C_{1-5}$ alkyl group, hydroxyalkyl and an organic group having between 6–26 atoms, $R^{13}$ is a methyl group or ethyl group and X- is a halide or sulfate group. Mixtures of the quaternary ammonium compounds may be used.

The preferred alkoxylated units are selected from the group consisting of ethyleneoxy, propyleneoxy, butyleneoxy and mixtures thereof. $R^{11}$ and $R^{12}$ combined preferably include from about 2 to 10 moles of alkoxylated units. Suitable alkylammonium compounds include dodecyl trimethyl ammonium chloride and isodecyloxypropyl dihydroxethylmethylammonium chloride. Commercially-available alkylammonium compounds include Q-17-2 from Tomah Products,Inc. and Foamquat 112 from Alzo, Inc. Matawan, N.J.

In this embodiment, the polyalkoxylated amine component preferably consists of from about 10–40% by weight of the composition, the water-soluble nonionic surfactant component consists of from about 20–80% by weight of the composition and the quaternary ammonium component comprises of from about 10–40% by weight of the composition.

At any time prior to the application step, there may be a further step of adding water to any of the compositions of the invention to achieve a final percent actives of between about 99.99 and 0.01% with a typical use range of 0–85% by weight. Water is the most preferred diluent but organic solvents such as ethanol, isopropanol, propylene glycol, hexylene glycol and petroleum distillates may also be used. Low molecular weight monohydric primary or secondary solvents such as methanol, ethanol, propanol, and isopropanol are preferred, but polyols containing 2 to 6 carbon atoms and from 2 to 6 hydroxy groups can be used. Examples of polyols include propylene glycol, ethylene glycol, glycerin. These products are available from a variety of commercial sources. Mixtures of such diluents are also acceptable.

The detergent composition of the invention may also include other standard detergent ingredients. These components are not required to practice the invention but may be used, for example, to build detergency or affect the aesthetics, stability, or shelf-life of the composition. Such adjuvants are known to one of ordinary skill in the art.

Illustrative optional adjuvants include: hydrotropes such as sodium toluene, xylene or cumene sulfonate among others, alkaline builders, colorants, fragrances, thickeners, suds control compounds, and bactericides, to name a few. McCutcheon's Volume 2: Functional Materials North American Edition, 1997 is a technical reference which indexes detergent ingredients by their function. This catalogue contains product information on many of the different categories of optional components listed above which is incorporated into the text of this description by reference. Typically, the other optional components mentioned herein may appear in the composition individually from 0–5% by weight with typical use levels each less than 2% by weight.

The optional alkaline builders benefit detergents such as the present invention in a number of different ways. For example, builders such as alkali metal phosphates and carbonates act as water softening chelating agents by sequestering calcium and magnesium ions. Examples of these types of builders include tetrapotassium pyrophosphate, and sodium tripolyphosphate both produced by FMC Corporation and sodium carbonate. Other exemplary builders suitable for use in the invention include alkai metal silicates which function as corrosion inhibitors. Examples include sodium metasilicate pentahydrate and potassium silicate produced by The PQ Corporation under the tradenames Metso Pentabead 20 and Kasil respectively. Builders are useful in the detergent compositions of this invention at total combined levels of from 0–90% by weight of the composition with a typical use range from 7–75% by weight.

EXAMPLES AND DATA

The cleaning tests were based on a standard procedure. The test protocol for Examples 1–4 consisted of placing 140 mL of a detergent solution into a beaker with stirring at a 1000 rpms, 23° C., and at the specified concentration. Then a soiled substrate was immersed in the detergent for 15 minutes. After which time, the percent soil removed from the substrate was calculated based on an average of three runs. The cleaning efficacy of the various surfactant compositions included in this application was determined by this method.

Example 1

Ternary Detergent Compositions

Detergent compositions consisting of three main components were prepared to evaluate the efficacy of the inventive detergent composition versus a prior art composition. Component A was an alkoxylated alcohol (nonionic surfactant) nonylphenol 9-mole ethoxylate, component B is a polyalkoxylated amine bis-(2-hydroxyethyl) isodecyloxypropylamine, component C is a polyalkoxylated amine oxide bis-(2-hydroxyethyl)isodecyloxypropylamine oxide and component D is a quaternary ammonium compound bis-(2-hydroxyethyl)isodecyloxypropyl methyl ammonium chloride.

The detergent compositions were diluted with water prior to the application step and had 1% actives. The hydrocarbon-containing soil to be removed from a glass test plate included a mixture of soybean oil and Crisco shortening oil.

The test was performed at 23° C. The soil-containing glass substrate was immersed in the dilute detergent composition for 15 minutes.

CLEANING PERFORMANCE

| Components (weight percent ratios) | %-soil removal |
|---|---|
| A | 0 |
| B | 3.3 |
| A, B, D (2:1:1) | 99.8 |
| A, B, C (2:1:1) | 99.8 |
| A, C, D (2:1:1) prior art | 34.5 |

Example 1 shows that the ternary compositions of the present invention outperform prior art detergent compositions which lack any polyalkoxylated amine component. These ternary compositions of the invention, which are based on the central component of alkoxylated amines, broaden the utility of the invention.

Example 2

Binary Detergent Compositions

Detergent compositions consisting of two main components were prepared to evaluate the efficacy of the inventive detergent composition. The components are set forth in the table below. weight percent ratios of the active ingredients were 1:1.

The detergent compositions were diluted with water prior to the application step and had 0.1% actives. The hydrocarbon-containing soil to be removed from a glass test plate included a mixture of motor oil and lithium grease.

The test was performed at 23° C. The soil-containing glass substrate was immersed in the dilute detergent composition for 3 minutes.

CLEANING PERFORMANCE

| Detergents | %-soil removal |
|---|---|
| bis-(2-hydroxyethyl)isodecyloxypropy-lamine & bis-(2-hydroxyethyl)isodecyloxypropylamine oxide | 56.6 |
| bis-(2-hydroxyethyl)isodecyloxypro-pylaxmine & poly (5) oxypropylene isodecyloxypropylamine oxide | 83.2 |
| bis-(2-hydroxyethyl) isodecyloxypropylamine & poly (5) oxyethylene isotridecyloxypropylamine | 80.3 |

Example 2 illustrates that various water soluble surfactants and alkoxylated amine binary compositions enhance the degreasing of hydrophobic hydrocarbon soils.

Example 3

Binary Detergent Compositions

Detergent compositions consisting of two main components were prepared to evaluate the efficacy of other forms of the inventive detergent composition. The components are set forth in the table below. Weight percent ratios of the active ingredients were 1:1.

The detergent compositions were diluted with water prior to the application step and had 1% actives. The hydrocarbon-containing soil to be removed from a glass test plate again consisted of a mixture of motor oil and lithium grease.

The test was performed at 23° C. The soil-containing glass substrate was immersed in the dilute detergent composition for 15 minutes.

CLEANING PERFORMANCE

| Detergents | %-soil removal |
|---|---|
| bis-(2-hydroxyethyl)isodecyloxypropylamine oxide | 0 |
| bis-(2-hydroxyethyl)isodecyloxypropylamine | 12.5 |
| bis-(2-hydroxyethyl)isodecyloxypropylamine & bis-(2-hydroxyethyl)isodecyloxypropylamine oxide | 95.8 |
| bis-(2-hydroxyethyl)fattycocoamine & bis-(2-hydroxyethyl)isodecyloxypropylamine oxide | 90.8 |

Example 3 demonstrates the utility of water soluble amine oxides in combination with alkoxylated amines to boost their degreasing performance.

Example 4

Detergent Composition With Different Component Ratios

A detergent composition consisting of two main components was prepared. Component A was a polyalkoxylated amine consisting of bis-(2-hydroxyethyl) isodecyloxypropylamine and component B was an amine oxide consisting of poly (5) oxypropylene isodecyloxypropylamine oxide. The detergent composition was diluted with water prior to the application step and had 1% actives. The hydrocarbon-containing soil to be removed from a glass test plate included a mixture of motor oil and lithium grease.

The test was performed at 23° C. The soil-containing glass substrate was immersed in the dilute detergent composition for 15 minutes.

CLEANING PERFORMANCE

| Weight Percent Ratio Component A to B | %-soil removal |
|---|---|
| 1:0 | 3.3 |
| 3:1 | 69.4 |
| 2:1 | 85.4 |
| 1:1 | 68.4 |
| 1:2 | 76.2 |
| 1:3 | 78.0 |
| 0:1 | 21.2 |

Example 4 illustrates that the optimum performance for different detergent composition of the present invention may not have the same optimal detergency ratio. In example 5 in the table above, a 2:1 ratio is the relative optimum whereas in example 1 in the table above a 3:1 ratio is the optimum. The synergistic, favorable results achieved at the foregoing ratios of active ingredients of the alkoxylated amine detergent compositions are advantageous and were not expected.

Example 5

Detergent Composition Foamability

As discussed above, it is advantageous to be able to control the level of foaming of the detergent composition based on the needs of the end user. Example 5 is directed to the foamability of the detergent composition of the invention.

In this example, a detergent composition consisting of two main components was prepared. Component A was a polyalkoxylated amine consisting of bis-(2-hydroxyethyl) isodecyloxypropylamine and component B was an amine oxide consisting of poly (5) oxypropylene isodecyloxypropylamine oxide. The detergent composition was diluted with deionized water prior to the application step and had 0.10% actives. The weight percent ratio of the components was varied to determine the effect of the ratios on foam production and stability as indicated in the following table.

The test protocol followed was ASTM designation: D-1173-53 titled the "Standard Test Method for Foaming Properties of Surface-Active Agents." Pursuant to the test protocol, 200 mL of each detergent composition was added to a reservoir containing 50 mL of the detergent composition. The detergent composition was added in a continuous flow at a vertical height of 90 cm above the level of detergent in the reservoir. Measurements of the level of foam generated by addition of the detergent to the reservoir were made at 0 minutes and again at 5 minutes. The test was performed at 23° C. The data appear in the following table.

DETERGENT COMPOSITION FOAM PROFILE

| Weight Percent Ratio Component A to B | Initial Foam 0 minutes | Foam Stability 5 minutes |
|---|---|---|
| 1:0 | 1.5 cm | 1.3 cm |
| 3:1 | 2.5 | 2.0 |
| 2:1 | 3.0 | 2.2 |
| 1:1 | 2.8 | 1.5 |
| 1:2 | 1.4 | 0.9 |
| 1:3 | 1.4 | 0.8 |
| 0:1 | 1.1 | 0.1 |

Example 5 illustrates how the components included in the detergent compositions herein disclosed affects the foamability of the compositions. In the case of Example 5 it is a low foaming composition which has unique application barring high foaming detergents.

While the principles of this invention have been described in connection with specific embodiments, it should be understood clearly that these descriptions are made only by way of example and are not intended to limit the scope of the invention.

What is claimed:

1. A method for cleaning hydrocarbon-containing soils from a surface with an aqueous cleaning composition comprising the steps of:

preparing a detergent composition consisting essentially of:

from 1–99% by weight of at least one polyalkoxylated amine having the general structural formula:

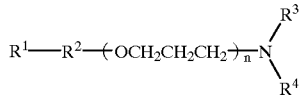

wherein $R^1$ is selected from an alkyl, aryl or alkylaryl group having between 6 and 22 carbon atoms, $R^2$ is from 0 to 7 moles of alkoxylated units, n is 0 or 1, $R^3$ and $R^4$ are each selected from H and from about 1 to 5 moles of alkoxylated units such that $R^3$ and $R^4$ are not both H and $R^3$ and $R^4$ combined include about 7 or fewer moles of alkoxylated units; and from 99–1% by weight of at least one amine oxide water-soluble surfactant having the general structural formula:

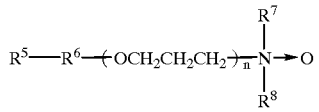

wherein $R^5$ is selected from an alkyl, alkylamidopropyl, hydroxyalkyl, aryl or alkylaryl group having between 6 and 22 carbon atoms, $R^6$ is from 0 to 7 moles of alkoxylated units, n is 0 or 1 and $R^7$ and $R^8$ are each selected from the group consisting of 1 to 10 moles of alkoxylated units, a $C_{1-5}$ alkyl group, hydroxyalkyl and an organic group having between 6–26 atoms; and at any time before cleaning, adding from about 90 to 99.99% by weight of water to the composition; and applying the detergent composition to the object to be cleaned.

2. The method of claim 2 wherein the alkoxylated units are selected from the group consisting of ethyleneoxy, propyleneoxy, butyleneoxy and mixtures thereof.

3. The method of claim 1 wherein $R^3$ and $R^4$ combined include from about 2 to 5 moles of alkoxylated units.

4. The method of claim 1 wherein the polyalkoxylated amine component is present in the amount of from about 15–85% by weight of the composition and the water-soluble surfactant amine oxide component is present in the amount of from about 85–15% by weight of the composition.

5. The method of claim 1 wherein the at least one amine oxide is selected from the group consisting of poly (5) oxypropylene isodecyloxypropylamine oxide, bis-(2-hydroxyethyl)isodecyloxypropylamine oxide and mixtures thereof.

6. The method of claim 1 wherein the detergent composition further includes from about 0.01–90% by weight of at least one builder.

7. The method of claim 6 wherein the builder is selected from the group consisting of tetrapotassium pyrophosphate, sodium tripolyphosphate sodium carbonate, sodium metasilicate pentahydrate and potassium silicate.

8. The method of claim 1 wherein the detergent composition further includes at least one adjuvant.

9. The method of claim 1 further including, at any time, adding less than about 30% by weight of at least one organic solvent to the detergent composition provided that the weight percent of the organic solvent is less than about 10% of the diluted composition when applied to the object to be cleaned.

10. A method for cleaning hydrocarbon-containing soils from a surface with an aqueous cleaning composition comprising the steps of:

preparing a detergent composition comprising:

from 0.5–99% by weight of at least one polyalkoxylated amine having the general structural formula:

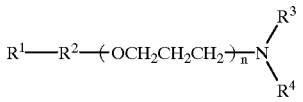

wherein $R^1$ is selected from an alkyl, aryl or alkylaryl group having between 6 and 22 carbon atoms, $R^2$ is from 0 to 7 moles of alkoxylated units;

n is 0 or 1 and $R^3$ and $R^4$ are each selected from H and from 1 to 5 moles of alkoxylated units such that $R^3$ and $R^4$ are not both H and $R^3$ and $R^4$ combined include about 7 or fewer moles of alkoxylated units;

from 99–0.5% by weight of a nonionic water-soluble surfactant selected from the group consisting of alkoxylated alkyl phenols, alkoxylated alcohols, alkoxylated glycosides and mixtures thereof; and from 99–0.5% by weight of at least one quaternary ammonium compound component having the general structural formula:

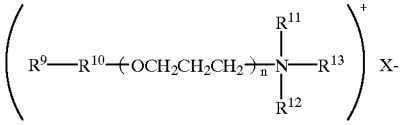

wherein $R^9$ is selected from an allyl, alkylamidopropyl, hydroxyalkyl, aryl or alkylaryl group having between 6 and 22 carbon atoms, $R^{10}$ is from 0 to 7 moles of alkoxylated units, n is 0 or 1, $R^{11}$ and $R^{12}$ are each selected from the group consisting of 1 to 8 moles of alkoxylated units, a $C_{1-5}$ alkyl group, hydroxyalkyl and an organic group having between 6–26 atoms, $R^{13}$ is a methyl group or ethyl group and —X— is a halide or sulfate group; and at any time before cleaning, adding from about 90 to 99.99% by weight of water to the composition; and applying the detergent composition to the object to be cleaned.

11. The method of claim 10 wherein the alkoxylated units are selected from the group consisting of ethyleneoxy, propyleneoxy, butyleneoxy and mixtures thereof.

12. The method of claim 10 wherein $R^3$ and $R^4$ combined include from about 2 to 5 moles of alkoxylated units.

13. The method of claim 10 wherein $R^{11}$ and $R^{12}$ combined include from about 2 to 10 moles of alkoxylated units.

14. The method of claim 10 wherein the polyalkoxylated amine is present in the amount of from about 10–40% by weight of the composition, the nonionic water-soluble surfactant is present in the amount of from about 20–80% by weight of the composition and the quaternary ammonium compound is present in the amount of from about 10–40% by weight of the composition.

15. The method of claim 10 wherein the alkoxylated alkyl phenols are selected from the group consisting of nonylphenol 9 mole ethoxylate and octylphenol 9 mole ethoxylate and mixtures thereof.

16. The method of claim 10 wherein the at least one quaternary ammonium compound component is selected from the group consisting of bis-(2-hydroxyethyl) isodecyloxypropyl methyl ammonium chloride, dodecyl trimethyl ammonium chloride, isodecyloxypropyl dihydroxyethylmethylammonium chloride and mixtures thereof.

17. The method of claim 10 wherein the detergent composition further includes from about 0.01–90% by weight of at least one builder.

18. The method of claim 17 wherein the builder is selected from the group consisting of tetrapotassium pyrophosphate, sodium tripolyphosphate sodium carbonate, sodium metasilicate pentahydrate and potassium silicate.

19. The method of claim 10 wherein the detergent composition further includes at least one adjuvant.

20. The method of claim 1 further including, at any time, adding less than about 30% by weight of at least one organic solvent to the detergent composition provided that the weight percent of the organic solvent is less than about 10% of the diluted composition when applied to the object to be cleaned.

21. The method of claim 1 wherein $R^7$ and $R^8$ combined include from about 2 to 7 moles of alkoxylated units.

* * * * *